US009368258B2

(12) United States Patent
Heffner

(10) Patent No.: US 9,368,258 B2
(45) Date of Patent: Jun. 14, 2016

(54) FORWARD TWISTED PROFILED INSULATION FOR LAN CABLES

(75) Inventor: Greg Heffner, Denver, PA (US)

(73) Assignee: Nexans, Paris (FR)

( * ) Notice: Subject to any disclaimer, the term of this patent is extended or adjusted under 35 U.S.C. 154(b) by 184 days.

(21) Appl. No.: 13/303,226

(22) Filed: Nov. 23, 2011

(65) Prior Publication Data

US 2013/0126209 A1 May 23, 2013

(51) Int. Cl.

| | |
|---|---|
| ***H01B 11/02*** | (2006.01) |
| ***H01B 11/06*** | (2006.01) |
| ***H01B 13/14*** | (2006.01) |
| ***H01B 7/02*** | (2006.01) |
| *H01B 11/18* | (2006.01) |
| *H01B 7/18* | (2006.01) |

(52) U.S. Cl.

CPC ..... *H01B 11/06* (2013.01); *H01B 7/0275* (2013.01); *H01B 13/14* (2013.01); *H01B 13/143* (2013.01); *H01B 7/02* (2013.01); *H01B 7/184* (2013.01); *H01B 7/185* (2013.01); *H01B 7/189* (2013.01); *H01B 11/02* (2013.01); *H01B 11/18* (2013.01)

(58) Field of Classification Search

CPC ..... H01B 7/02; H01B 7/184; H01B 7/185; H01B 7/189; H01B 7/0233; H01B 7/0275; H01B 11/02; H01B 11/04; H01B 11/06; H01B 11/18; H01B 3/00; H01B 3/30; H01B 13/14; H01B 13/143

USPC ..... 174/113 R, 113 C, 25, 27, 26 R, 88 R, 174/103, 110 R, 113 AS

See application file for complete search history.

(56) References Cited

U.S. PATENT DOCUMENTS

| | | | | |
|---|---|---|---|---|
| 3,717,987 | A * | 2/1973 | Gilmore et al. | 57/9 |
| 6,272,828 | B1 * | 8/2001 | Walling et al. | 57/58.49 |
| 6,608,255 | B1 * | 8/2003 | Donner et al. | 174/110 R |
| 2007/0098940 | A1 | 5/2007 | Heffner | |
| 2008/0283274 | A1 * | 11/2008 | Stutzman et al. | 174/113 R |
| 2009/0229851 | A1 | 9/2009 | Thuot et al. | |
| 2009/0229852 | A1 | 9/2009 | Thuot et al. | |
| 2010/0181093 | A1 * | 7/2010 | Wiekhorst et al. | 174/113 R |
| 2010/0276178 | A1 * | 11/2010 | Keller et al. | 174/113 C |

* cited by examiner

*Primary Examiner* — Ishwarbhai B Patel
*Assistant Examiner* — Paresh Paghadal
(74) *Attorney, Agent, or Firm* — Sofer & Haroun, LLP

(57) ABSTRACT

The present arrangement provides a twisted pair of conductors, each with a profiled insulation thereon, where in the twisted pair, the peak to peak contact of adjacent conductor insulation is ensured along the length of the pair. To this end, each of the profiled insulations on the conductors of the pair are forward twisted prior to twinning to ensure the maximum number of peak to peak contacts per unit length of the pair.

4 Claims, 16 Drawing Sheets

10G PROFILE BLUE 9 LOBE
CROSS SECTIONAL AREA = 0.00101932 SQ. IN.
INSULATION WEIGHT = 0.428951 GMS/FT

FORWARD TWISTED PROFILED INSULATION FOR LAN CABLES

BACKGROUND

1. Field of the Invention

This application relates to wire insulation. More particularly, this application relates to profiled insulation for LAN cables.

2. Description of Related Art

Copper cables are used for a variety of tasks, such as power transmission and signal transmission. In signal transmission tasks, the choice of insulation is of particular concern. For example, twisted pairs of copper conductors used in data cables (e.g. LAN (Local Area Network) cables) must meet certain fire safety standards and be cost effective, while minimizing signal degradation. Such signal degradation may be caused by factors such as interference with adjacent conductors, and inductance ith the insulation.

Thus, in developing copper wire signal cables, often having multiple twisted pairs of copper wire within the same jacket, there are the competing concerns of minimizing cost while maximizing signal strength and clarity. FIG. 1 shows a common prior art design having eight conductors grouped into four twisted pairs, in this example shown with an optional cross filler. In order for the cable to function properly, the impedance measurement between the two copper conductors of a twisted pair must be precisely maintained. This is achieved by insulating the conductor with a dielectric material. However, the dielectric material has a negative impact on the electrical signal and contributes to signal losses as well as other undesirable electrical phenomena. In addition, this dielectric material adds cost to the cable construction and often has a negative impact on cable fire performance, such as in UL™ (Underwriters Laboratories) testing. Thus, it is desirable to find ways to reduce the amount of dielectric material in proximity to the copper conductor without affecting the impedance (e.g. target of 100 ohms) between the two copper conductors forming the twisted pair.

Several approaches have been taken in the past to reduce the amount of dielectric material in proximity to the copper conductors without reducing the impedance of the twisted pair made from said copper conductors. For example, some manufacturers have replaced typical copper wire dielectric insulation with a foamed dielectric insulation which adds a gas component to the insulation. This yields a reduction in the amount of dielectric material necessary to maintain the impedance of the twisted pair. It is known that the typical gases used to foam dielectric materials have a dielectric constant close to 1 (most desirable), whereas known dielectric materials without the gas component have a dielectric constant substantially greater than 1, so this approach would appear, at first glance, to aid in resolving the concerns. However, this method not only increases the complexity of the extrusion process, but often requires additional manufacturing equipment. It is also difficult to manufacture a data communications cable with good electrical properties using this type of process.

Another method to reduce the amount of insulation while simultaneously maintaining the impedance between a twisted pair of conductors is to add openings (air or inert gas filled) within the insulation itself. However, prior art methods for producing such insulation with longitudinal air/gas openings require complex extrusion designs that may not produce the intended results or have otherwise produced ineffective results due to failure to maintain stable production of the openings during manufacturing.

Yet another manner for maintaining the impedance between a twisted pair of conductors while reducing the amount of insulation material used within a signal cable is to use what is termed "profiled" insulation. Profiled insulation refers to an insulation that is provided around a copper wire conductor, the cross-section of which is other than substantially circular. Such examples of profiled insulation may include saw tooth structures or other similar designs intended to both separate the conductors from one another while using less insulation than a solid insulator of similar diameter but yielding the same impedance between twisted pairs of conductors. One Example, of this type of insulation may be found in U.S. Pat. No. 7,560,646. See prior art FIG. 2.

In this arrangement, peak to peak contact between the profiled insulation of two conductors in a pair is desirable so as to maximize the distance between the conductors. This is shown for example in FIG. 3. However, owning to inconsistencies in the twinning process (where the two conductors are twisted around one another to form the twisted pair) at some points, the peak of one conductor insulation may "nest" into a valley of an adjacent conductor insulation as shown in FIG. 4. This situation undesirably shortens the distance between the conductors negatively affecting impedance. Moreover, if the nesting occurs periodically, the result is that along the pair at some points there is peak to peak contact and at other points there is peak to valley contact resulting in inconsistent impedance measurements along the length of the pair.

It is noted that certain prior art documents such as U.S. Patent Publication No. 2009/0229852 teaches the forward and/or back twisting (explained in more detail below) of profiled insulation for ensuring nesting. With profiled insulations, the peaks and valleys run longitudinally. The twinning operation of two conductors around one another inherently imparts some twist to the profiled insulation on each conductor. This prior art arrangement uses a back-twisting operation to counter this inherent twisting of the profiled insulation so that the peaks and valleys in the pair remain longitudinal to that corresponding peaks and valleys on the insulations of the two conductors in the pair match and thus more easily nest. As noted in the penultimate paragraph of the '852 application, the resulting impedance measurements are improved because in peak to peak contact designs, the peaks may crush during the twinning process

OBJECTS AND SUMMARY

There is a need for an arrangement that minimizes the amount of insulation used and maximizes the distance between the conductors in a twisted pair while simultaneously ensuring a constant and stable design along the length of the entire twisted pair.

The present arrangement address this issue by providing a twisted pair of conductors, each with a profiled insulation thereon, where in the twisted pair, the peak to peak contact of adjacent conductor insulation is ensured along the length of the pair.

To this end, each of the profiled insulations on the conductors of the pair are forward twisted prior to twinning to ensure the maximum number of peak to peak contacts per unit length of the pair. This design maintains the minimal use of insulation as a result of the profiled insulation and maximizes the distance between the conductors in a twisted pair.

Moreover, the present arrangement utilizes certain combination of insulation/polymer selection with the shape and/or dimension of the peaks/valleys, ensuring that the peaks do not excessively crush during the twinning process.

To this end, the present arrangement provides a twisted pair of conductors having a first insulated conductor having a profiled insulation and a second insulated conductor having a profiled insulation, where the first and second insulated conductors are twisted around one another, in a first direction into a pair and where the first and second insulated conductors are both forward twisted in the same first direction as the direction of twist of the pair.

BRIEF DESCRIPTION OF THE DRAWINGS

The present invention can be best understood through the following description and accompanying drawings, wherein.

DETAILED DESCRIPTION

Figure 1:
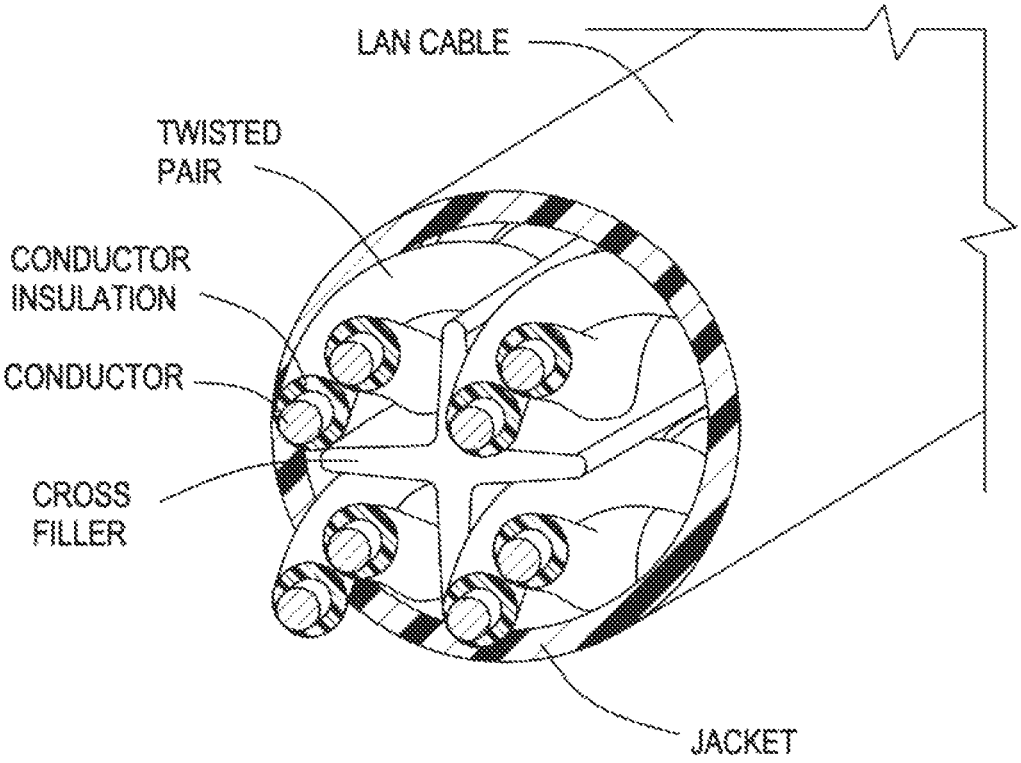
FIG. 1 (PRIOR ART)
FIG. 1 shows a prior art LAN cable with twisted pairs.
Figure 2:
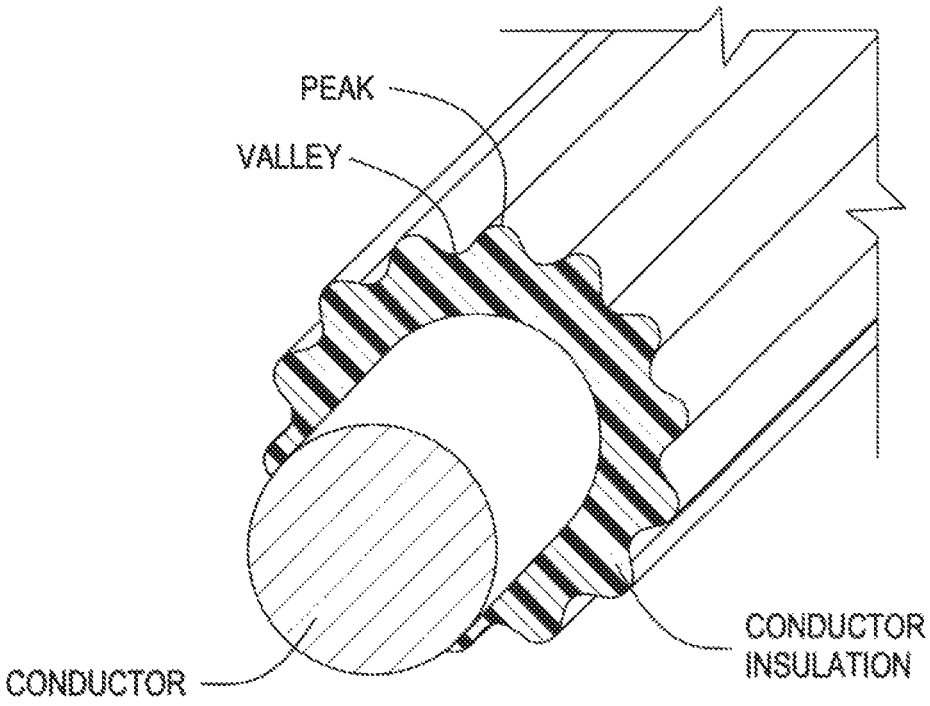
FIG. 2 (PRIOR ART)
FIGS. 2-4 show prior art profiled insulation used as insulation on conductors in twisted pairs.
Figure 3:
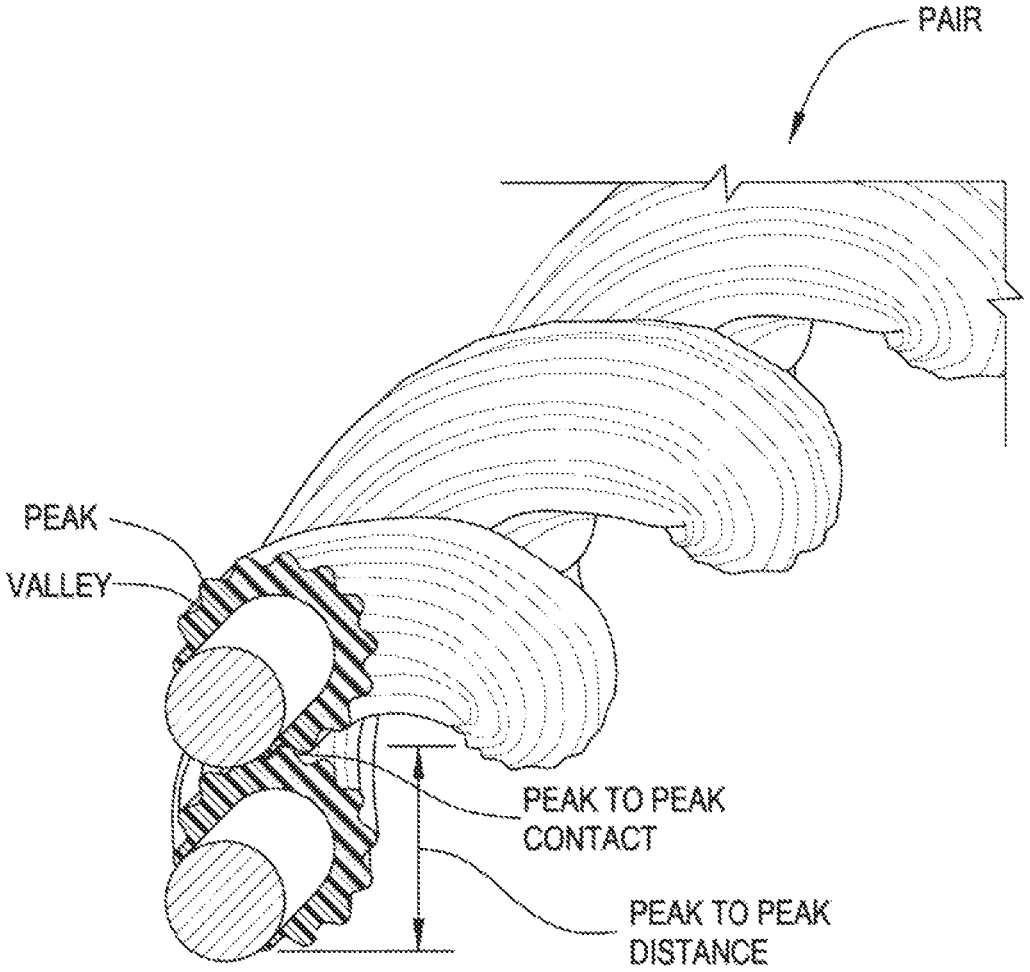
FIG. 3 (PRIOR ART)
Figure 4:
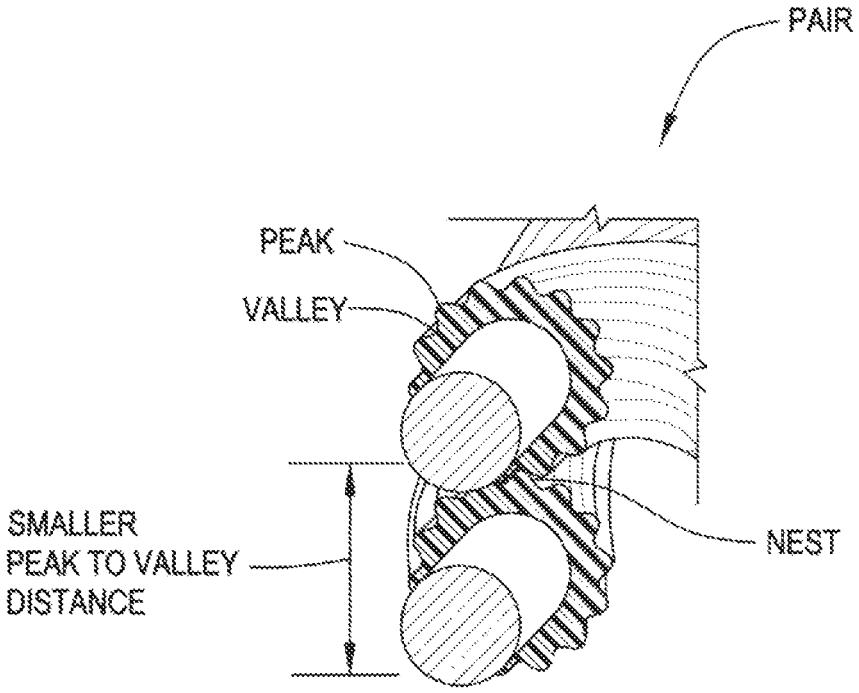
FIG. 4 (PRIOR ART)
Figure 5:
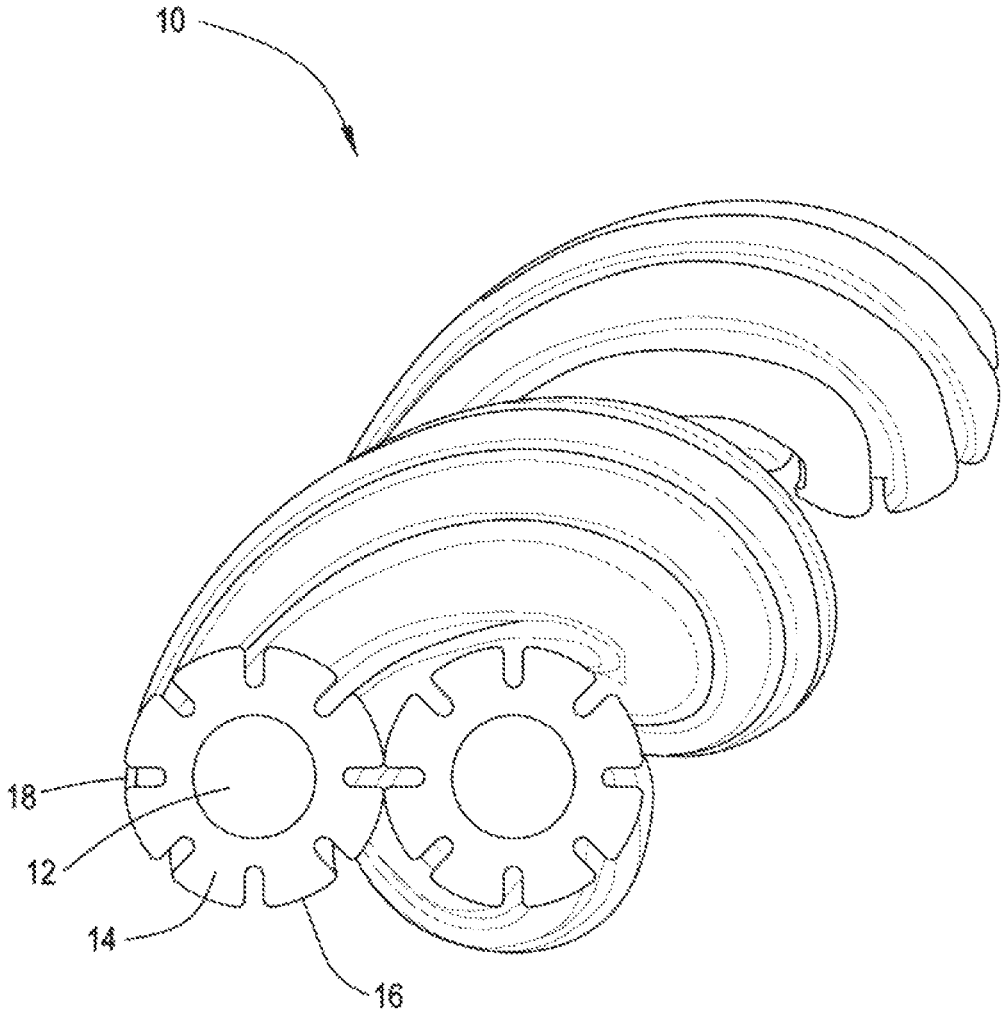
FIG. 5 shows a twisted pair with profiled insulation in accordance with one embodiment.

Applicants begin by providing a basic structure for a twisted pair 10 according to the present arrangement as shown in FIG. 5. Pair 10 has two conductors 12, each of which is surround by a profiled insulation 14, having successive peaks 16 and valleys 18. Such pairs are described throughout in the context of LAN type network communication cables, such as that shown in FIG. 1, however, the invention is not limited in that respect. The presently described pairs 10 may be used in any twisted pair arrangement, such as those found in large count network cables, telephone cables etc. . . . It is noted that FIG. 5 is solely to show the constituent parts of pair 10 and insulated conductors 12/14 irrespective of any forward twisting, which are discussed in more detail below.

The polymer used in profiled insulation 14 may be selected from fluorinated polymers such as (FEP) Fluorinated Ethylene Propylene, (PFA) Perfluoroalkoxy, (ETFE) Ethylene Tetrafluoroethylene, (PTFE) Polytetrafluoroethylene, and also Polyolefin's such as (PE) Polyethylene's, (PP) Polypropylene's and (FPE and FPP) Flame Retardant PE and PP.

In the present arrangement, FEP is preferred for Plenum LAN applications due to its excellent dielectric constant, high resistivity to chemicals and flame resistance. Polypropylene is preferred for non-plenum applications due to its improvement over polyethylene in dielectric constant, resistant to fatigue, cut through strength and rigidity.

It is noted that the above materials for the polymer for profiled insulation 14 is in no way intended to limit the scope of the present arrangement. It is contemplated that other polymers may be used as long as they are stable enough to endure the twinning process without undue crushing as explained in more detail below.

Figure 6A:
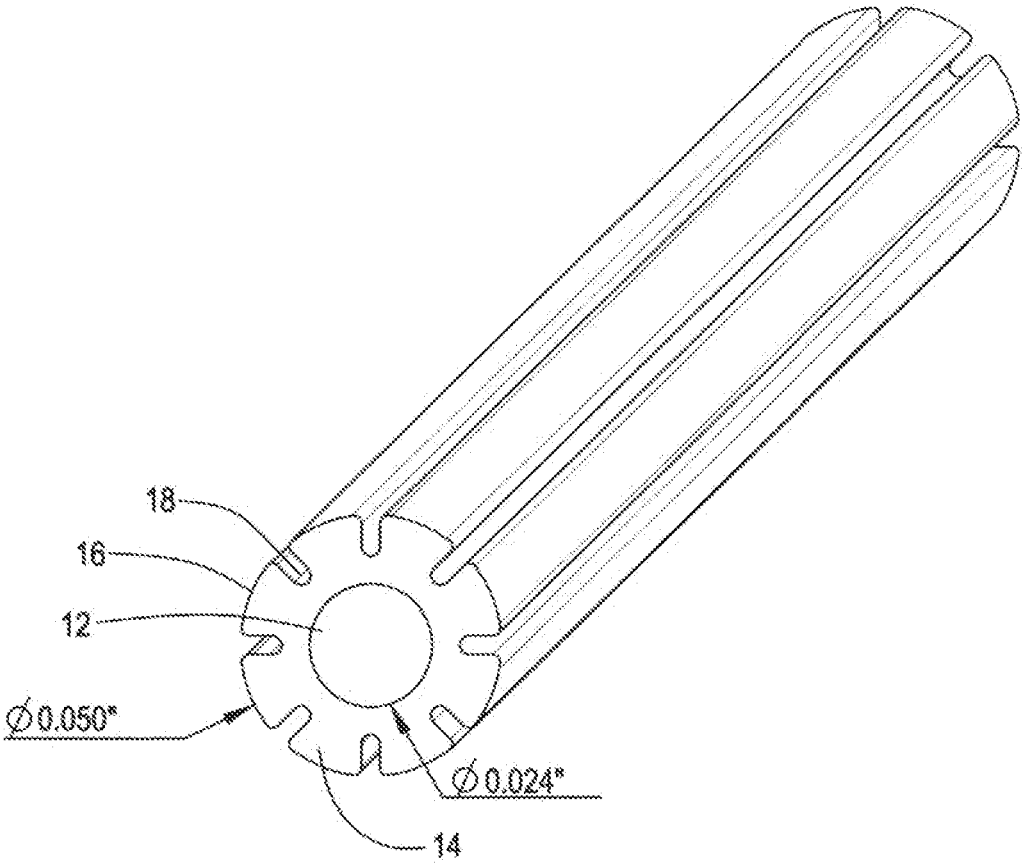
FIGS. 6A-6B show one profiled insulated conductor of a pair of FIG. 5, in accordance with one embodiment.

Turning to the dimensions of peaks 16 and valleys 18 on profiled insulation 14, as shown in FIG. 6A a typical conductor 12 dimension for LAN cables is 0.024" (diameter) which can advantageously range from 0.010" up to 0.040". The insulation diameter can be 0.050" (such as on 0.024" conductors 12) and advantageously range from 0.015" up to 0.100."

The number of profile insulation peaks 16 and valleys 18, and their corresponding dimensions vary depending on the particular cable application. However, for a typical LAN cable, the ideal number of peaks and valleys are a combination of eight (8) peaks 16 and valley 18 and nine (9) peaks 16 and valleys 18, with an ideal range of seven (7) to ten (10) peaks 16 and valleys 18 and an overall range from two (2) to twenty five (25) peaks 16 and valley 18.

Figure 6B:
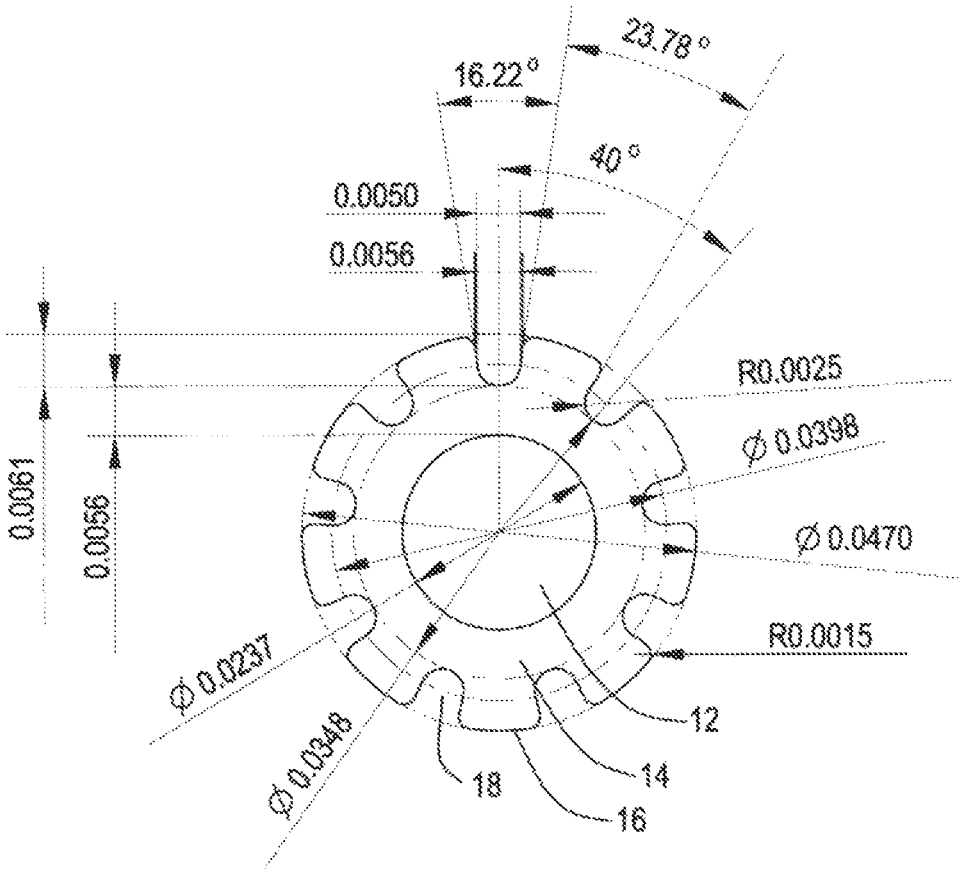
Figure 6C:
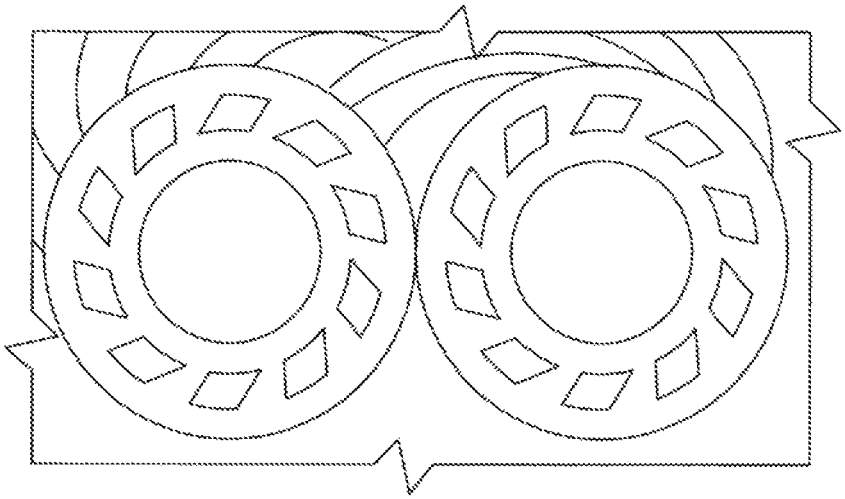
FIG. 6C illustrates an alternative embodiment of profiled insulation, in accordance with one embodiment.

FIG. 6C shows an alternative arrangement for profiled insulation 14 for use on conductors 12 where the "profiles" are opening running as channels longitudinally along the length of insulation 14. Such profiled insulation may likewise be forward twisted prior to twinning into pair 10 as discussed below so as to maximize the cross-over of the spines supporting such profiles, to prevent crushing during twinning. However, to illustrate the salient feature of the present arrangement, the profiled insulation 14 as shown in FIGS. 6A and 6B are used throughout this application.

In one arrangement, different versions of pair 10 may be used within the same LAN cable. For example, a first pair 10 within a LAN cable application (typically having four (4) pairs) may use eight (8) peaks and valleys, whereas one or more other pairs in the same LAN cable may use nine (9) peaks and valleys. Such variations are all within the contemplation of the present arrangement. For example, the LAN cable skew parameters may set certain limits on the different twist rates of pairs 10 within a cable. Different numbers of peaks and valleys may be used in the context of the present arrangement to maximize conductor to conductor distance in each pair 10, with different lay length pairs 10 using different numbers of peaks and valleys to accommodate the different crushing forces.

Valleys 18 are typically evenly spaced around the outer circumference of the insulation and the shape is designed so that the resultant corresponding adjacent peaks 16 are offered maximum support while removing as much insulation 14 as needed. Too many valleys, or incorrect valley shape and insulation may lead to crushing or nesting during twinning.

In the present example, as shown in FIG. 6A, for the purposes of the illustrated examples, conductor 12 is dimensioned at 0024" and insulation 14 has an outer diameter of 0.050." There are eight (8) valleys 18 forming eight (8) separate peaks 16.

Regarding the shape of the peaks—The tops of peaks 16, as shown in FIG. 6B have a height corresponding to the full outside diameter of insulation 14. The depths of each of valleys 18 are substantially 0.0061" and cut across about 16° of the circumference of insulation 14. The associated dimensions as a result the shape of valleys 18 are also shown on FIG. 6B.

It is contemplated that the dimensions of valleys 18 as well as the resultant corresponding shape of peaks 16 in combination with the material selected for insulation 14 results in a peak that is stable enough to withstand crushing forces under twinning. For example, the flattened tops of peaks 16 are such that they maximize the distribution of forces imparted by the adjacent insulation 14 (and peaks 16) experienced during twinning, such that peaks 16 do not downwardly deform, preventing conductors 12 from corning closer together.

The present example shown in FIG. 6B is only one example of such a shape, but it is contemplated that other similar shaped peaks 16 may meet this crush resistance criteria.

Figure 7:
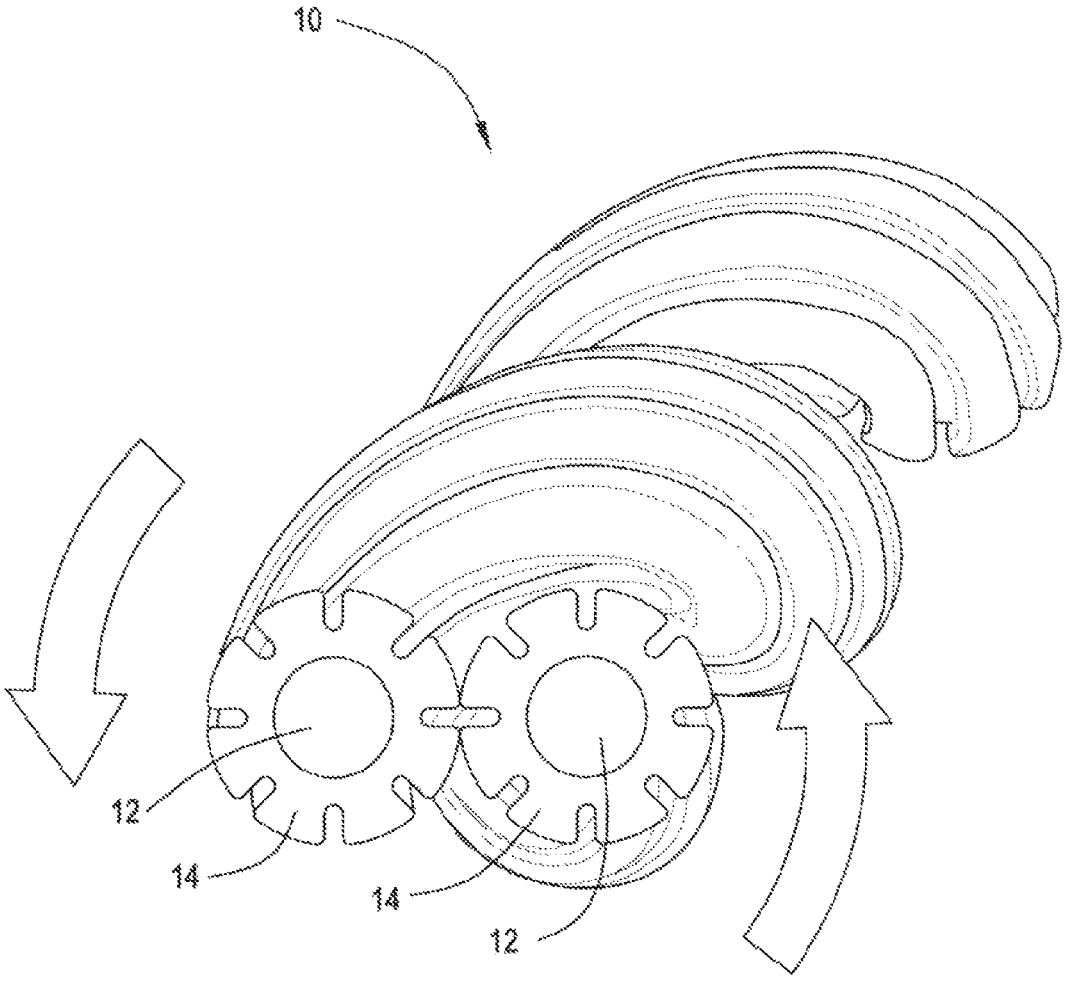
FIG. 7 is a schematic drawing of twisted pair without insulated conductor pre-twisting.

Turning to the creation of pair 10, this is done through the process generally known as twining. FIG. 7, similar to FIG. 5, is a basic figure showing a counterclockwise twinning of two insulated conductors as shown in FIG. 6 into a pair. The arrow shows the counter clockwise rotation of the pair imparted by the twinning process (may be done in clockwise as well). This process is done for the length of the two conductors in one direction to produce a helically twisted pair.

Figure 8A:
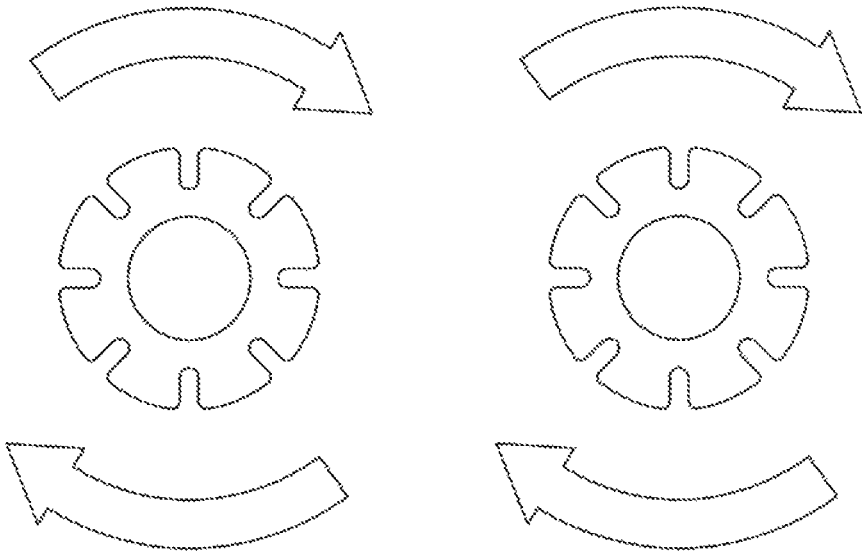
FIGS. 8*a* and 8*b* are schematic drawings of a back twisting operation for a twisted pair.
Figure 8B:
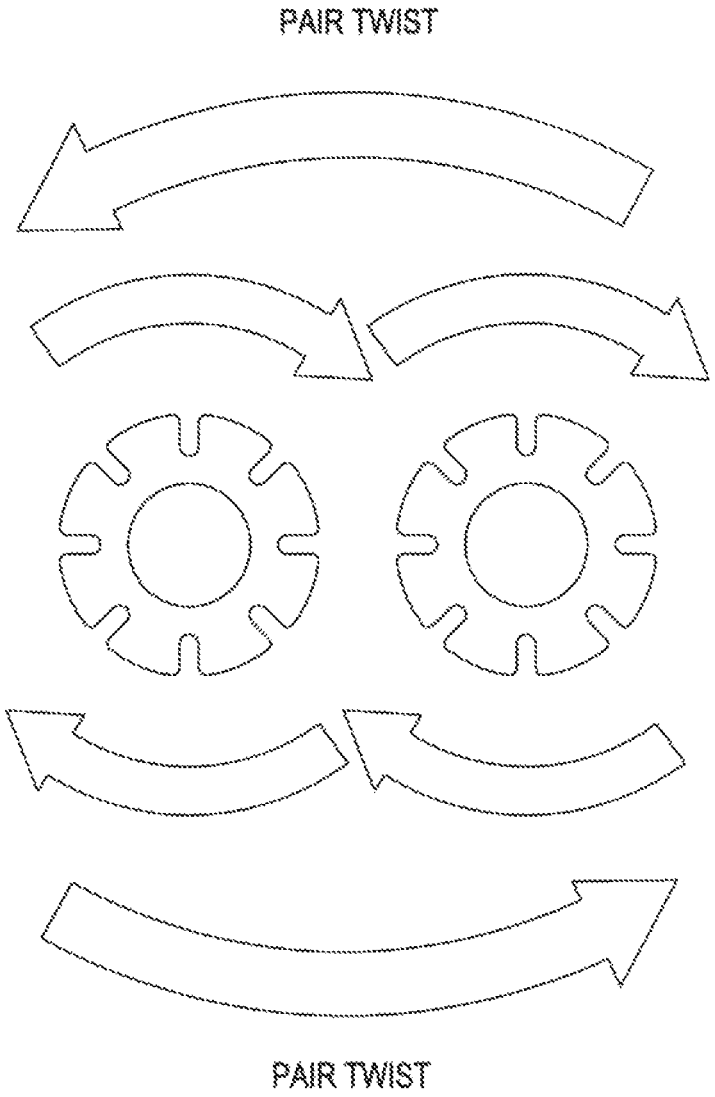

The concept of "forward twisting" and "back twisting" refer to the twisting of the insulated conductors themselves, prior to the twinning process shown in FIG. 7, compared to the overall pair twist. For example, back twisting is shown in FIGS. 8A and 8B where each of the insulated conductors is first twisted in a clockwise direction, prior to being twinned with the other conductor. Once the two insulated conductors touch each other, they are both twisted together (twinned) in the counterclockwise direction (hence "back" twisting). In the prior art back twisting is occasionally used in some cases to randomize the contact between insulated (non-profiled) conductors because insulation wall thicknesses on circular/cylindrical insulations are not always perfectly concentric due to inevitable extrusion conditions. By randomizing non-concentric insulated conductors, the insulated conductors touch each other at points having different wall thicknesses. This reduces the effect of bad concentricity in the electrical test results by homogenizing the conductor to conductor distance along the length of the pair.

Figure 9A:
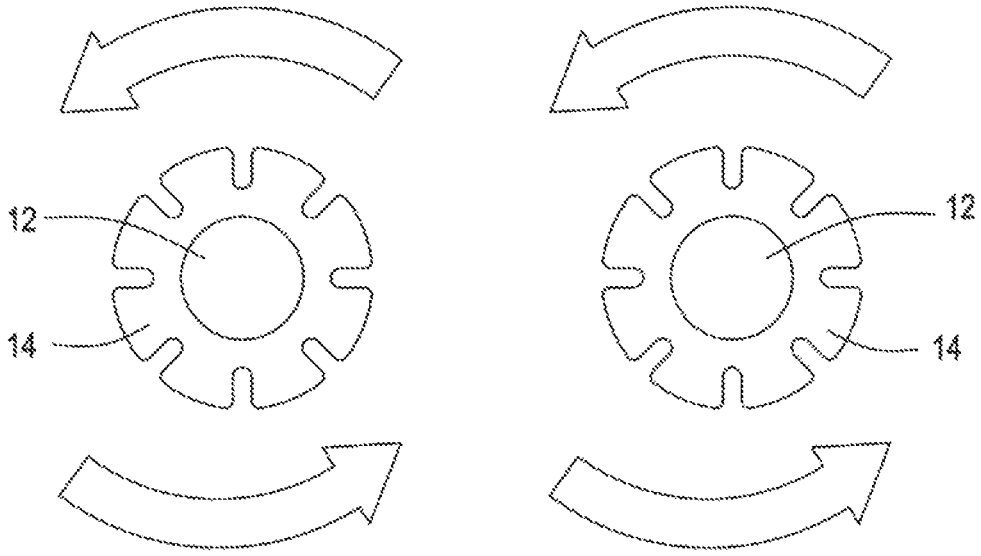
FIGS. 9*a* and 9*b* are schematic drawings of a forward twisting operation for a twisted pair.
Figure 9B:
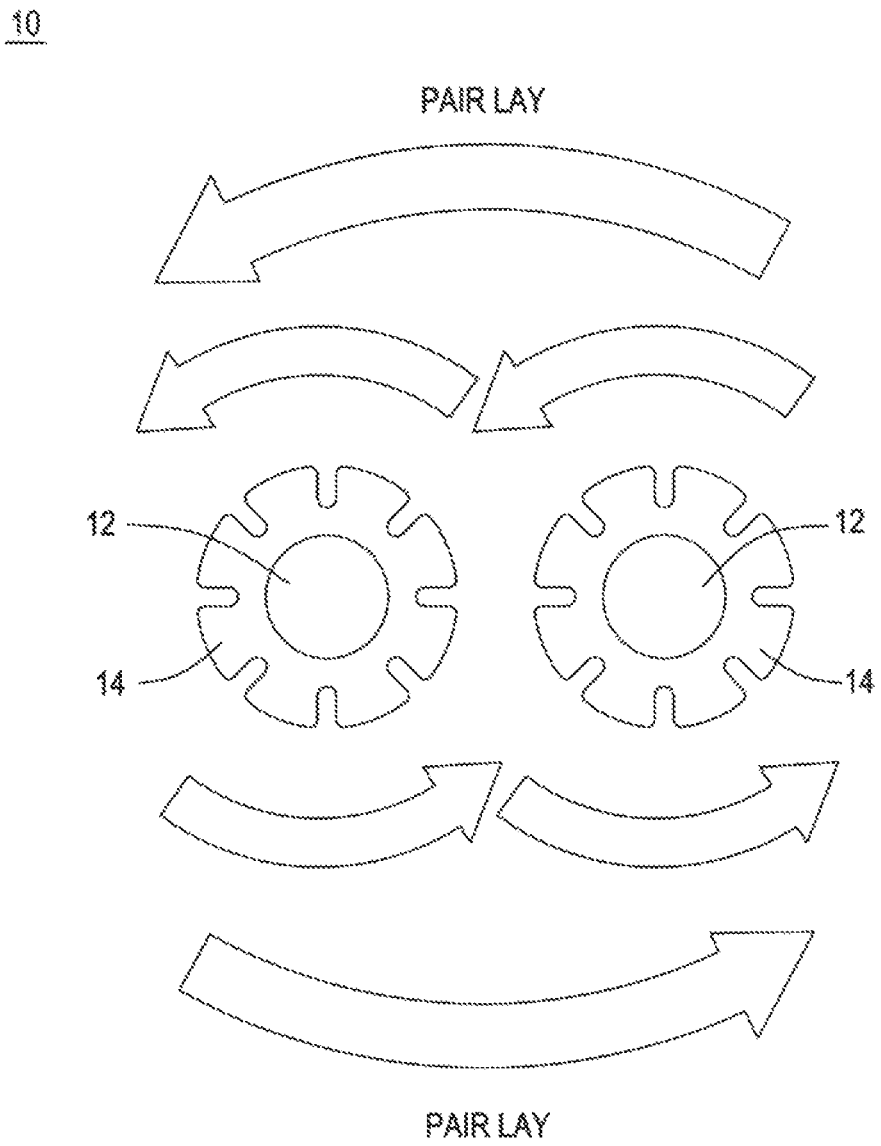

On the other hand, according to the present arrangement, forward twisting as shown in FIGS. 9A and 9B is where each of the insulated conductors 12/14 is first twisted in a counterclockwise direction, prior to being twinned with the other conductor. Once the two insulated conductors touch each other, they are both twisted together again in the same counterclockwise direction (hence "forward" twisting).

In this context, the present arrangement uses the forward twisting concept as shown in FIGS. 9A and 9B. This process results in pair 10 as shown in FIGS. 10 and 11 as discussed in more detail below.

Figure 10:
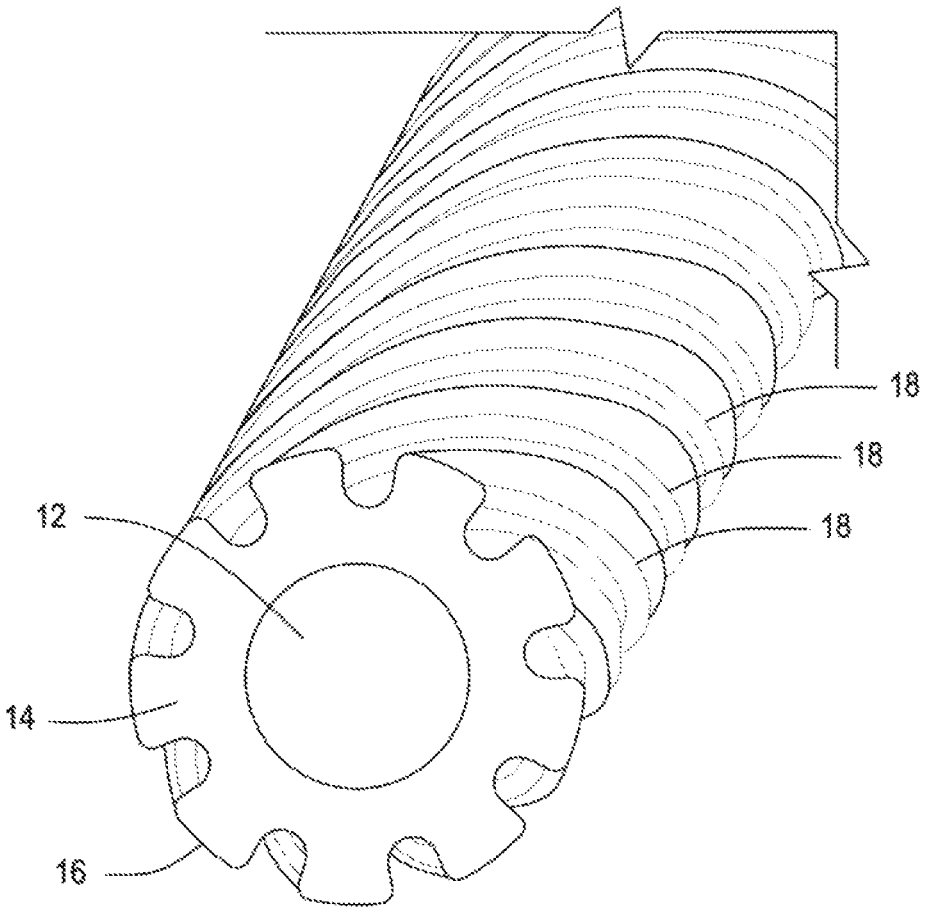
FIG. 10 shows a single insulated conductor forward twisted prior to twinning.

Turning to the specifics of the forward twisting and twinning process of pair 10 of FIGS. 10 and 11, pair insulated conductors 12/14 of pair 10 are twinned in a range of 0.2" to 1.0" per twist. In other words, if the twinning rate for pair 10 is 1.0" inches per twist, that means that for each linear inch of pair 10, insulated conductors 12/14 make one complete (counterclockwise) twist around one another.

Regarding the forward twisting of each insulted conductor 12/14 prior to twinning, this is done in the range of about 83% to 100% of the rate of twinning, but may potentially be up to 200%. In other words, assuming a forward twist of 100% on a pair twinned at 1.0" inch, each insulated conductor 12/14 is first forward twisted 1 full counterclockwise revolution so that any one point on the insulation is fully twisted (100%) over the course of that one inch. Similarly, assuming a forward twist of 80% on a pair twinned at 1.00 inch, each insulated conductor 12/14 is first forward twisted 0.8 of a full rotation (per inch).

Figure 11A:
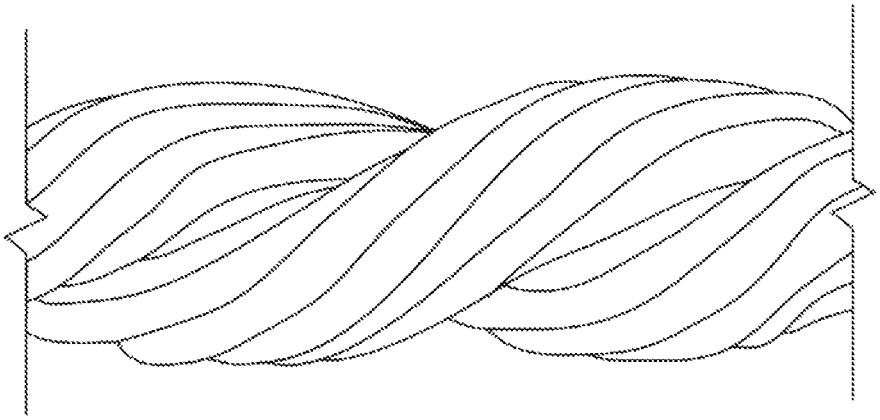
FIG. 11A (PRIOR ART)
FIGS. 11A and 11B are side views showing the prior art non-forward twisted conductors in a pair compared with forward twisted conductors in accordance with one embodiment.
Figure 11B:
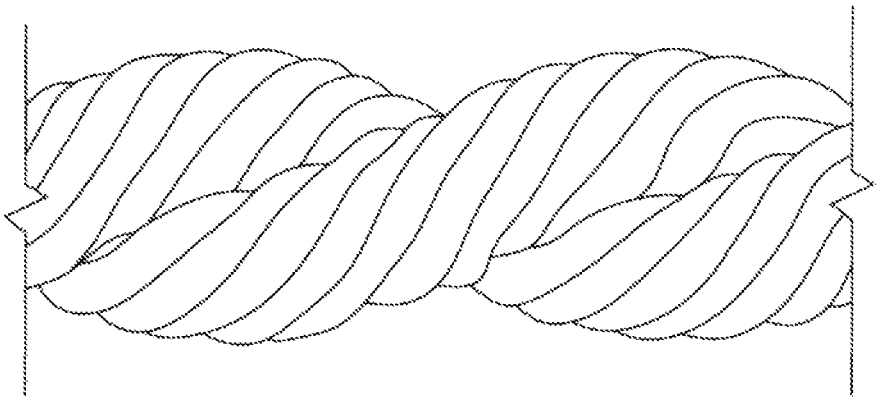

FIG. 10 shows insulated conductors 12/14 with a forward twist, as evidenced by valleys 18 being shown in a counterclockwise twist. When twinned with another forward twisted insulated conductor 12/14 into pair 10, this results in a pair 10 as shown in FIG. 11B. Thus, as a result of the forward twisting, the peaks 16 on each of insulated conductors 12/14 are in a maximum of peak-to-peak contact after twinning, as the non-linear peaks 16 and valleys 18 of insulation 14 results in many cross-overs per unit length along the length of pair 10. FIG. 11A by comparison shows a prior art profiled insulation pair with no forward twisting of the individual profiled insulation conductors. Such a prior art arrangement has many more instances of nesting along the length of the pair.

It is noted that for any pair 10 different twinning lay lengths may be used and thus a different percentage of forward twisting may likewise be used. For example, the smaller the twinning lay length of pair 10, the higher the forward twist must be to stop the crushing and nesting of peaks 16 and valleys 18. Lesser forward twisting of each conductor 12, such as the 83% forward twisting described above, may be used on insulations 14 of pairs 10 that have longer twinning lay lengths and thus don't crush as much as the shorter lay length pairs. Ideally, although at least 83% forward twisting of insulation 14 is used, the higher the forward twist percentage, the slower the assembly/twinning line and associated forward twisting machine must run. So, while it is possible to run over 100% forward twist rates on insulations 14, the drawback that the production line speed is reduced, so there is a balance between forward twisting enough to prevent peak 16 crushing, while still maintaining line speed.

Figure 12:
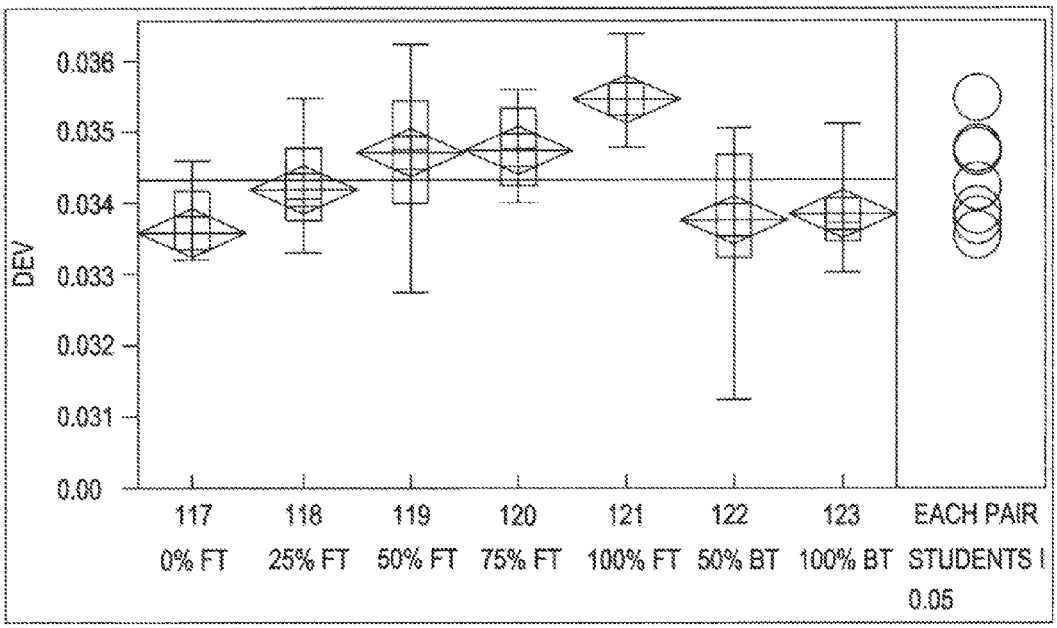
FIG. 12 is a comparative chart showing the conductor to conductor distances in a twisted pair, comparing prior art to the present arrangement.

The following description and related FIG. 12 shows an exemplary test of the arrangement as shown in FIG. 11 as compared to no twisting or back twisting of insulated conductors. In the test, the same twinning rate of 0.279" per twist and speed of 1815 twists per minute (assembly line speed) were used. The only variable was the forward/back twist percentages.

Starting on the x-axis of the graph on FIG. 12, this shows a simulated comparison of samples having 0%, 25%, 50%, 75% and 100% forward twisting as well as 50% and 100 back twisting. The y-axis of the graph shows the distance between the centers of the two conductors in the pair. The tests were repeated several times for each sample with the center of the triangles (data points) showing the average results over the tests. The tops and bottoms of the vertical data point lines show the maximum outlining results, with the triangle and central rectangle outlining the statistically consistent measurements over the repeated tests, for each sample construction.

As illustrated in FIG. 12, the use of 0% forward twisting shows results essentially similar to 50% and 100% backtwisting, whereas the use of 25%, 50%, 75% and 100% forward twisting of conductors 12 in pair 10 each show progressively greater distances between the two conductors. Thus, as expected, the increased peak to peak contact between conductors 12 in pair 10 when forward twisting is used prior to twinning results in greater conductor to conductor distances in pair 10, improving impedance performance.

As such, the forward twisting of the profiled insulation of about 100% (or 83% for longer lay length pairs) combines the advantages of profiled Insulation, without resulting in the crushing of peaks 16, thus maintaining conductor 12 to conductor 12 distance in pair 10, making it more effective in this respect regarding impedance characteristics (e.g. 100 ohm target).

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. A twisted pair of conductors, said pair comprising:

a first insulated conductor having a series of peaks and valleys forming a profiled insulation; and a second insulated conductor having a series of peaks and valleys forming a profiled insulation, wherein said first and second insulated conductors are twisted around one another in a first direction into a twisted pair;

wherein said first and second insulated conductors are both independently forward twisted along their own individual axis in the same first direction as the direction of twist of said twisted pair prior to being twisted into said twisted pair such that peaks of said first and second insulated conductors abut one another in a substantially non-parallel manner, so as to substantially prevent said peaks of said profiled insulation of said first and second conductors from nesting in said valleys of said profiled insulation on the corresponding first and second conductors in said pair, so that the distance between two conductors is maximized in a twisted pair along the length of the entire twisted pair, wherein said first and second insulated conductors are both forward twisted in the same first direction as the direction of twist of said pair at a range of substantially 83% to 100%.

2. The twisted pair as claimed in claim 1, wherein said profiled insulation on said first and second insulated conductors is constructed having substantially seven to ten peaks and valleys forming said profile.

3. The twisted pair as claimed in claim 2, wherein said profiled insulation on said first and second insulated conductors has an outer diameter of approximately 0.050" with said valleys formed as cuts in the outer diameter of said insulation of substantially 0.0061" and cut across about 16°.

4. The twisted pair as claimed in claim 1, wherein said first and second insulated conductors are twisted around one another, in a first direction into a pair at a twist rate of a range of 0.2" to 1.0" per twist.

* * * * *